United States Patent [19]

Hurtgam

[11] Patent Number: 4,635,987

[45] Date of Patent: Jan. 13, 1987

[54] GOLF BALL RETRIEVING DEVICE

[76] Inventor: Mervin W. Hurtgam, 3261 Andrews Rd., Ransomville, N.Y. 14131

[21] Appl. No.: 761,595

[22] Filed: Aug. 1, 1985

[51] Int. Cl.[4] ..... A63B 47/02

[52] U.S. Cl. ..... 294/19.2; 56/400.11

[58] Field of Search ..... 294/19.2, 52, 53.5, 294/55, 57; 56/328 R, 400.01, 400.04, 400.05, 400.07, 400.11, 400.12, 400.16, 400.19, 400.21; 273/32 B, 32 D, 32 F, 162 B, 162 E, 162 F

[56] References Cited

U.S. PATENT DOCUMENTS

| | | | |
|---|---|---|---|
| 322,022 | 7/1885 | Thayer et al. | 56/400.11 |
| 691,843 | 1/1902 | Craig | 56/400.11 X |
| 1,014,250 | 1/1912 | Norman | 56/400.21 X |
| 1,372,558 | 3/1921 | Saxl | 56/400.11 |
| 1,393,299 | 10/1921 | McIntosh | 294/52 |
| 2,517,874 | 8/1950 | Hatch | 294/57 X |
| 2,738,214 | 3/1956 | Zimmers | 294/19.2 |
| 4,254,981 | 3/1981 | Wilson | 294/19.2 |

*Primary Examiner*—Johnny D. Cherry

*Attorney, Agent, or Firm*—William J. Crossetta; Michael L. Dunn

[57] ABSTRACT

A device is disclosed for retrieving golf balls from mud and silt, such as found in the bottom of a pond or stream, which comprises a ball retrieval head having curved tines with guiding legs and a lower stabilizing member which act cooperatively to dislodge the ball from its position in the mud for engagement and holding by the curved tines in the retrieval process.

17 Claims, 9 Drawing Figures

Fig. 4.
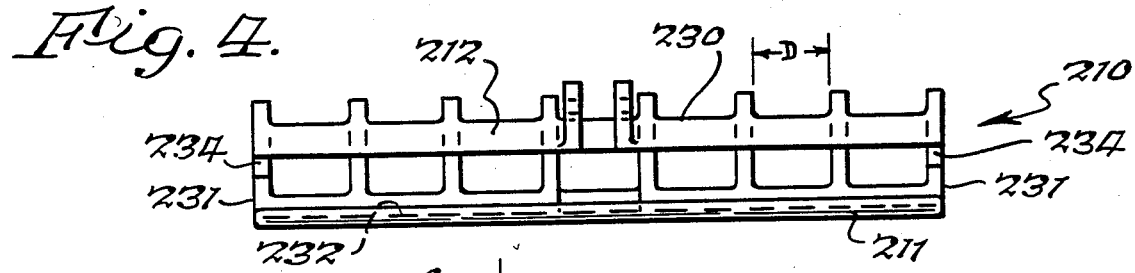
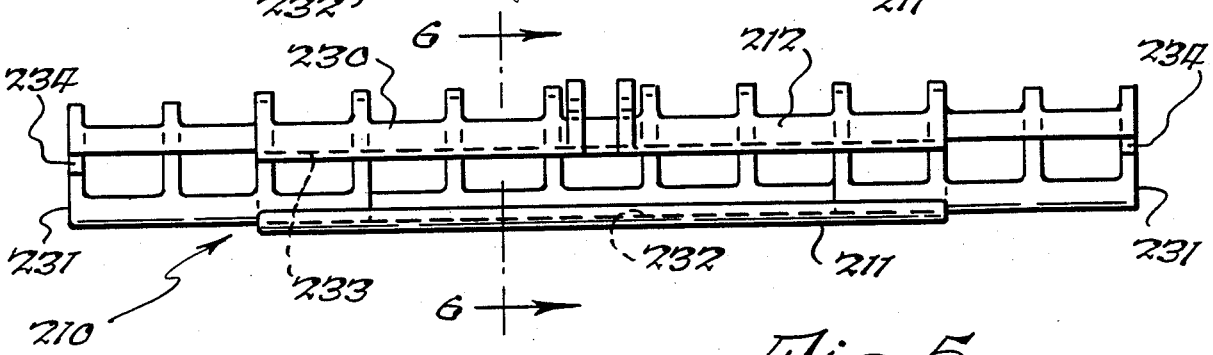
Fig. 5.
Fig. 6.
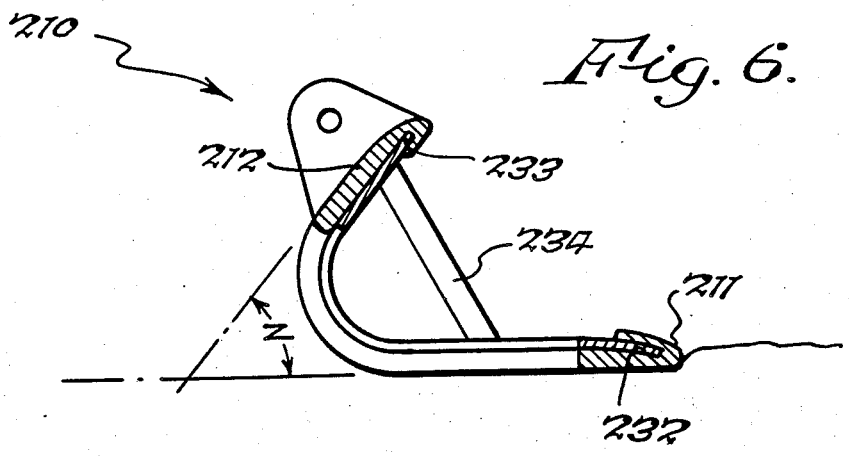

GOLF BALL RETRIEVING DEVICE

FIELD OF THE INVENTION

This invention relates to devices for the retrieval of golf balls and particularly to devices for retrieving golf balls which are particularly embedded in the mud, silt or sand of ponds or streams.

BACKGROUND OF THE INVENTION

The game of golf enjoys popular participation throughout the civilized world and accessories which allow more convenient accomplishment of the sport are generally in great demand. One particular problem frequently encountered in the sport is the retrieval of golf balls from muddy or other poorly accessible regions where they have been errantly directed. Typically, the golfer is ill prepared to conveniently recover such errantly directed balls, particularly those which have found their way to the bottom of streams or ponds. Many devices have been prepared to retrieve said errant balls but few, if any, have enjoyed widespread acceptance.

U.S. Pat. No. 3,306,650 describes a device for retrieving golf balls from tall grass, water or other obstacles and includes a plurality of flexible rake tines extending from a base, much as fingers spread from the palm of a hand, wherein the tines can be compressed together to form a golf ball sized basket for retrieving a golf ball or extended to form a rake. Such apparatus can only retrieve a single ball at a time, requires patient dexterity on the part of the operation, and is of limited utility for retrieving balls from murky waters where lack of clear visibility of the ball stymies effective retrieval.

U.S. Pat. No. 3,773,374 describes a golf ball retrieving device comprising two parallel swinging hooks which act together to retain a single ball placed therebetween. Again, as with the aforediscussed device, the apparatus requires significant dexterity on the part of the operator, is difficult to control and utilize in murky water and thus is of limited utility to the golfer.

U.S. Pat. No. 4,411,463 discloses a golf ball retriever in the form of a rake with straight tines having connecting adjacent legs extending perpendicularly from an upper support bar acting to engage balls for retrieval. Such device works better than the previously discussed apparatus but does not adequately retrieve the balls, particularly those which are embedded in the mud or silt of the water barrier.

None of the aforesaid devices enjoys widespread use and each has multiple disadvantages to the golfer.

SUMMARY OF THE INVENTION

The instant device functions as both a superior golf ball retriever and even as a sand rake in its varying forms. In its preferred form it comprises an elongated handle, preferably a telescoping handle, with an elongated ball retrieval head connected thereto. The elongated head is comprised of a plurality of curved, fixed, spaced apart tines, of extended leg length, interconnected by a fixed upper and lower stabilizing member. The novel configuration of the elongated head allows golf balls to be scooped, unseen, from the bottom mud of murky waters while allowing for a sand rake function.

DESCRIPTION OF THE INVENTION

FIG. 4 is a plan view of an extendable ball retrieval head of the invention in its compressed position.

FIG. 5 is a plan view of the extendable ball retrieval head depicted in FIG. 4 shown in extended position.

FIG. 6 is a vertical section view of the extendable ball retrieval head depicted in FIGS. 4 and 5 along line 6—6 of FIG. 5.

Figure 1:
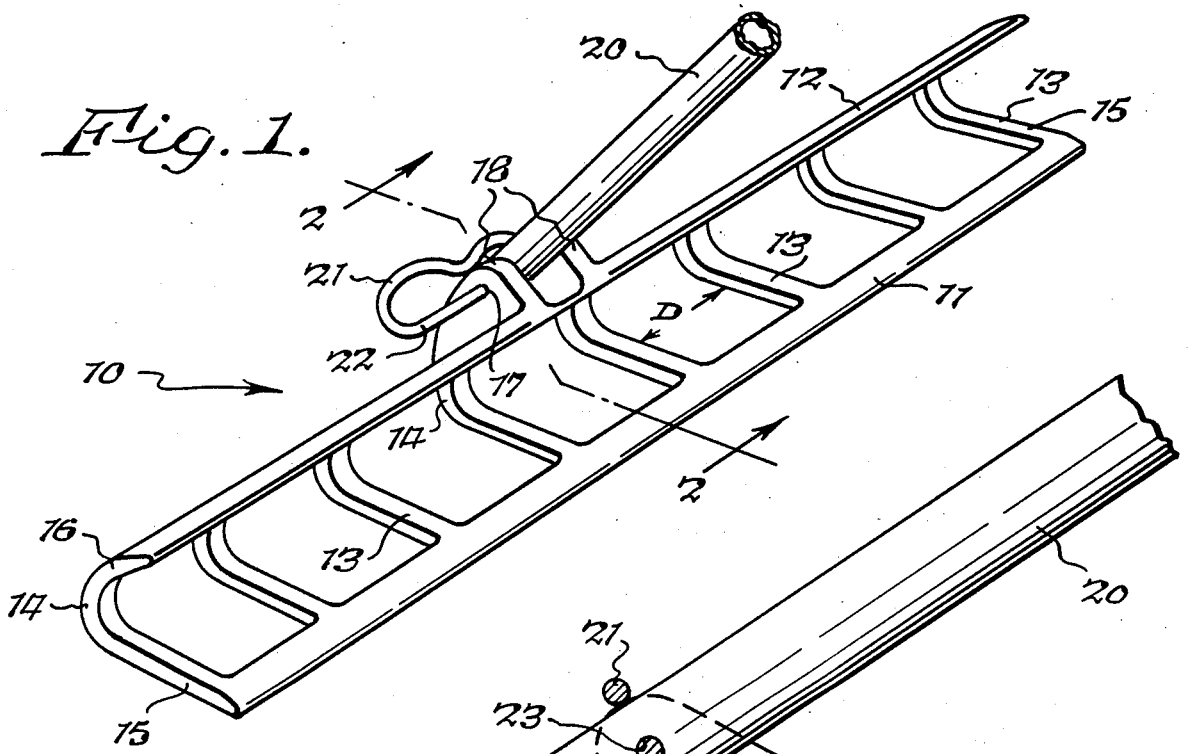
FIG. 1 is a perspective view of a fixed length elongated ball retrieval head with a spring clip for connecting the head to a handle.

The golf ball retrieving device of the instant invention comprises an elongated ball retrieval head comprising a fixed upper stabilizing member and a lower stabilizing member; a plurality of curved, spaced apart tines, each said tine including guiding legs and a bight portion, extending between said fixed upper and said lower stabilizing members, means for fixedly connecting said upper stabilizing member to said bight portions of said tines, means for connecting said lower stabilizing member to guiding legs of said tines, each of said guiding legs of said tines extending to the lower stabilizing member from the bight portion, being greater in length than one half the radius of the curvature of the bight; and, means for connecting an elongated handle to the retrieval head. In its preferred form, the device of the invention includes an elongated handle.

When referring to the various component sections of the tines, the curved portion is referred to as the bight; the upper leg, if present, is referred to as the supporting leg; and the lower leg is referred to as the guiding leg. Hereinafter, the supporting leg is generally included as means for connecting the bight portion of a tine to the upper stabilizing member.

The novel configuration of the elongated head acts to allow the scooping of golf balls, seen or unseen, from the bottom mud of murky or muddy waters with the lower stabilizing member and extending tine guiding legs acting cooperatively to extract an embedded golf ball from the bottom mud in which it has been retained and directing the extracted ball to the bight portion of the tines which act as a retainer for easy and effective golf ball retrieval by the golfer. In one version of the invention, whereupon the guiding legs of the tines extend beyond the fixed or movable lower stabilizing member, the device further acts as a superior sand rake, with the lower stabilizing member also serving a sand leveling function. Even when the guiding legs of the tines terminate at the lower stabilizing member, the device can act in place of a sand rake with the lower stabilizing member functioning as a sand leveling bar.

The elongated head of the golf ball retrieving device can be formed of any suitable material such as plastic or metal and can be of fixed length, or may be in whole or part foldable or retractable. One preferred mode of the invention comprises an elongated head with a fixed center portion and a telescoping portion on either or both ends. Such preferred mode would allow compaction of the elongated head for convenient storage in the typical golf bag. Another preferred mode of the invention comprises an elongated head with fixed center portion and hinged end portions which can be extended into place for use and folded for convenient golf bag storage. A pin connecting means for attaching a handle to the elongated head provides easy removal of the elongated ball retrieval head for convenient storage. It is apparent from the invention that the configuration of the elongated head suggests multiple modes all of which are included within the claimed invention.

The connection means for connecting the ball retrieval head to the handle can be any suitable fixed, detachable or adjustable connection means. The handle can be permanently fixed to the head, or detachable means such as spring clip attachment means or threaded socket means may be used. Such attachment means allows easy detachment of the elongated head from the handle for quick and easy storage. Adjustable connecting means, such as ball and socket means which can modify the angle of the elongated head, particularly the angle of the guiding legs of the tines relative to the longitudinal axis of the handle, is a preferred means of connecting as it allows adjustment of the elongated head to various lake bottom configurations or for easier sand raking. In this regard, it should be noted that the position (included angle) of the guiding legs of the tines relative to the central axis of the handle (angle X shown in FIG. 2) can be fixed or adjustable and can vary from about parallel to an included angle of about 80°, for achieving its ball retrieval function. For use as a sand rake, however, the included angle can even be greater than 80° up to about 150°. Thus, for combined function the ball retrieval head is preferably adjustable to a configuration such that the guiding legs of the tines can be angled from about 0° (parallel) to about 150° to the handle and most preferably from about parallel to the handle to a configuration about perpendicular to the handle. It is of course contemplated within the disclosure of this invention that the elongated head be at a fixed angle to the handle as well as to include combined connecting means and included angle adjusting means. In addition to the included angle adjustment means aforedescribed, it is contemplated within the invention to include means for adjusting the lateral angle (angle Y shown in FIG. 3) of the retrieval head from its preferred working position perpendicular or thereabout to the handle, to a storage position approximately parallel to the handle. To obtain such lateral angle adjustment capability, combined with included angle adjustment capability, the aforedescribed ball and socket type connecting means has been found suitable. A further understanding of the invention will be provided in the following description of the drawings.

Figure 2:
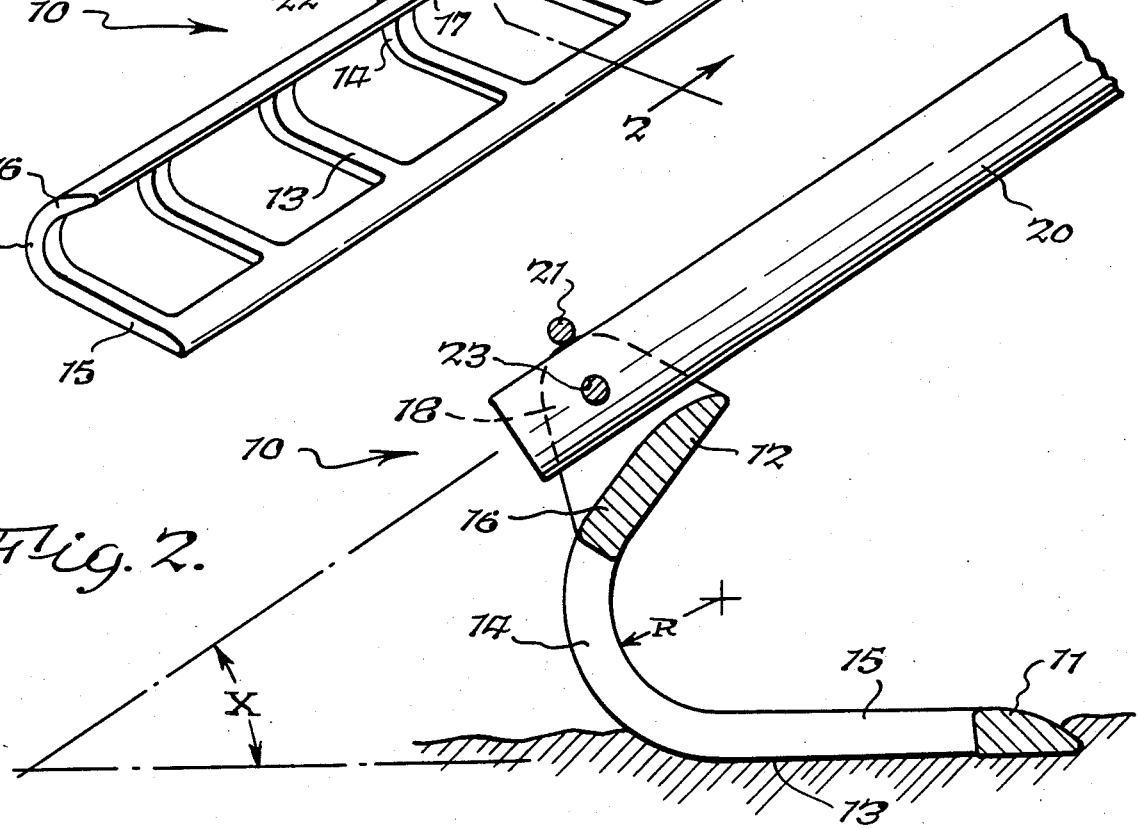
FIG. 2 is a vertical cross-sectional view of the invention depicted in FIG. 1, along line 2—2.
Figure 3:
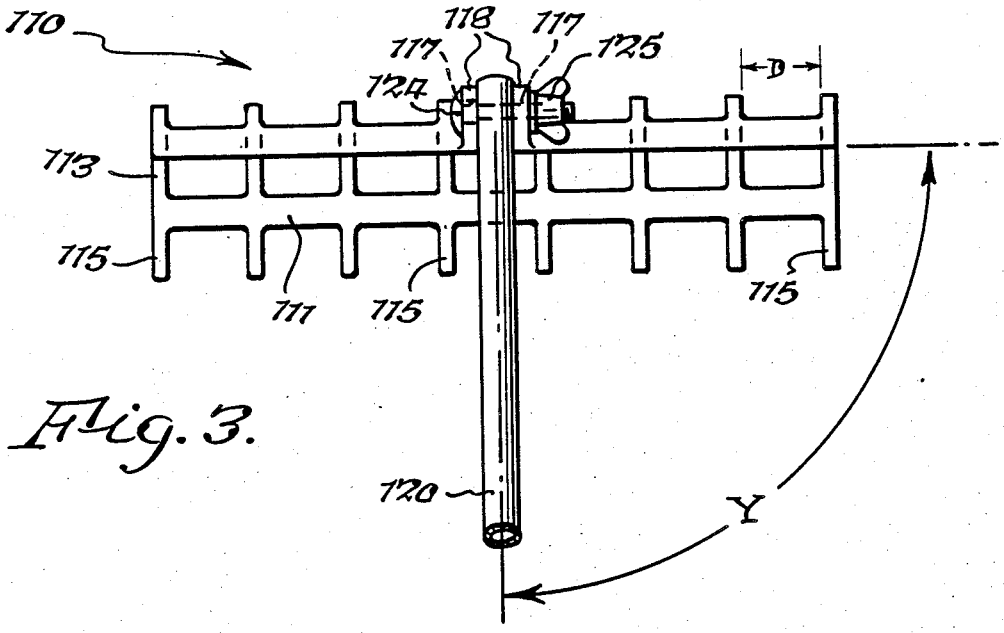
FIG. 3 is a plan view of a modified form of the invention having projecting tines and adjustable handle fastening means.

Referring now to the drawings; FIGS. 1 and 2 illustrate one mode of the invention wherein the elongated ball retrieval head is indicated generally by the reference numeral 10 and a detachable handle is indicated by the numeral 20. Referring to the elongated ball retrieval head 10, which comprises lower stabilizing member 11 and upper stabilizing member 12 having secured therebetween multiple curved rigid and/or semi-rigid tines 13. Each tine comprises a bight 14, which is the curved portion of the tine, the guiding leg 15 which comprises the straight portion of the tine extending from the bight 14 to the lower stabilizing member 11 and alternately the supporting leg 16 which comprises the straight portion of the tine connecting with the upper stabilizing member. It should be understood that the supporting leg 16 is not a required element of the tine 13 and the upper stabilizing member 12 may be directly fixed to the bight 14 of the tines 13. The radius of the curvature (R as shown in FIG. 2) of the bight 14 can be varied widely from about 70% to about 150% of the radius of a golf ball. Generally, it is preferred that the radius of the bight 14 be from 80% to less than about 100% of the radius of the golf ball so that during use the ball will tend to lodge between tines. The extent of the curvature of the tines, from a guiding leg to an upper supporting leg, is such to assure the angle of the guiding leg to the upper supporting leg (angle Z, FIG. 6), is 90° or less. The distance (D as shown in FIGS. 1, 3 and 4) between tines, at the bight, can also be varied greatly from about 30% to about 90% of the diameter of a golf ball. Generally, it has been found that a distance of from about 80% to about 98% of the diameter of a golf ball is preferred. Generally, I have also found it to be preferable that the tines 13 be approximately parallel to each other in the extended position of the retrieval head, but the device has also been found effective where the head is curved with the guiding legs of the tines radiating to a common remote point. Thus, the invention includes a retrieval head wherein all or none of the guiding legs of the tines are parallel as well as a mixture wherein two or more tines are parallel or not parallel.

The upper stabilizing member 12 of FIGS. 1 and 2 is depicted as being fixedly attached to the bight 14 of the tines 13. It should be understood, however, that upper supporting legs 16 can also be extended from the bight to the upper stabilizing member or even beyond the upper stabilizing member.

FIGS. 1 and 2 depict a nonadjustable connecting head, being spring clip 21 attachment means with pin section 22 extending through holes 17 of support bodies 18 through holes 23 of elongated handle 20. It is understood of course, that the handle 20 can be of fixed or variable length.

FIG. 3, illustrates another embodiment of the invention wherein an elongated ball retrieval head 110 comprises a lower stabilizing member 111 positioned so that the lower guide legs 115 of the tines 113 extend beyond the lower stabilizing member. The connecting means depicted therein is an adjustable connecting means wherein the handle 120 is pivotably connected to the retrieval head 110 through holes 117 of support bodies 118, by bolt pin 124 and locking nut 125. The lower guide legs 115 extending beyond the lower stabilizing member 111 allow the retrieval head to more effectively function as a leveling rake, while the adjustable connecting means allows adjustment of the angle of the lower guide legs to the handle for ball retrieval or raking function.

FIGS. 4, 5 and 6 illustrate a further preferred embodiment of the invention wherein the ball retrieval head is adapted for extendable length. Therein a ball retrieval head 210 is comprised of a base head 230 with slidably mounted extender sections 231. Referring specifically to FIGS. 5 and 6, the extender sections 231 are slidably mounted in slots 232 and 233 of lower stabilizing member 211 and upper stabilizing member 212 respectively. The length of the retrieval head can be further elongated by merely sliding out one or more extender sections 231. A further preferred embodiment of this invention comprises ball retaining end caps 234 on extender section 231 to provide a convenient gripping means for extending the sections and to prevent recovered balls from rolling out of the retrieval head. It should be understood that retaining end caps are a preferred embodiment in each of the modes of the invention specifically described herein. The handle is attached to the retrieval head of FIGS. 4, 5 and 6 by simple pin attachment means.

Figure 7:
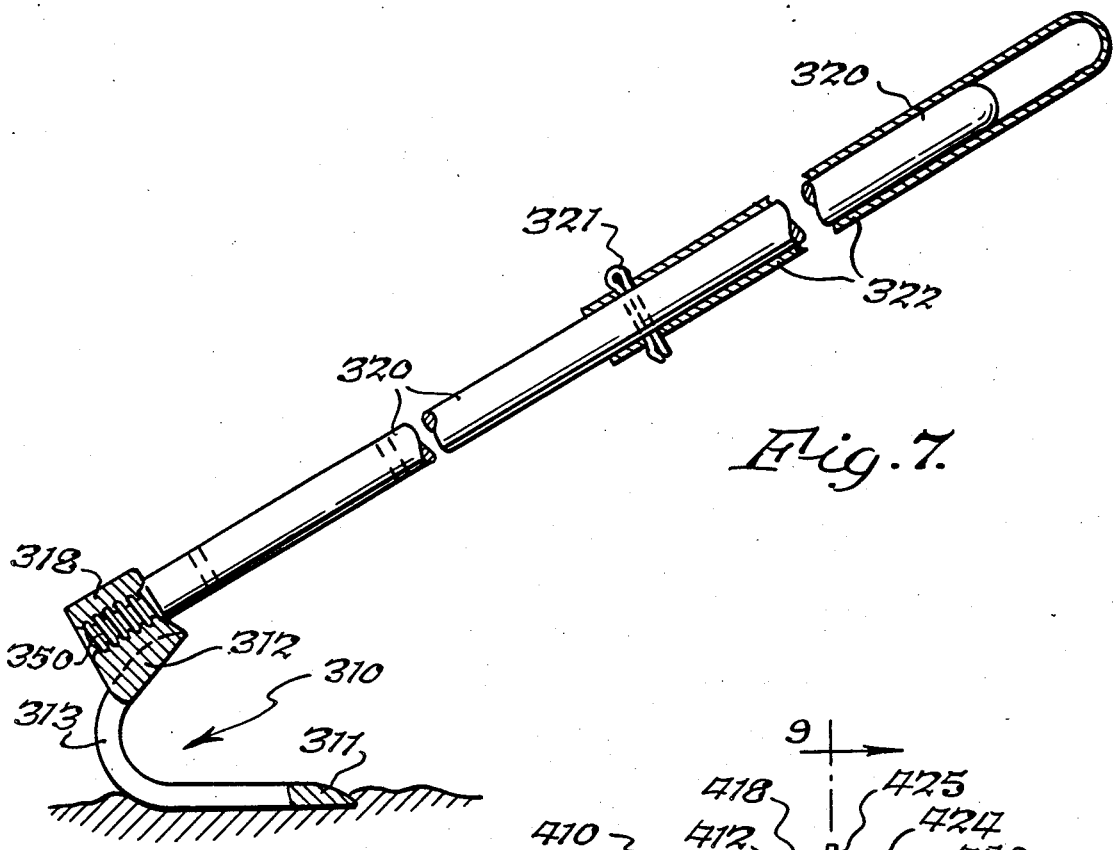
FIG. 7 is a vertical cross-sectional view of the invention having a telescopic handle with threaded socket connecting means.

FIG. 7 illustrates an embodiment of the invention wherein elongated ball retrieval head 310, comprising lower stabilizing member 311, tines 313, upper stabilizing member 312 and threaded socket support body 318, is removably attached to handle 320 by threaded end 350, said handle comprising telescopic portion 322 with spring clip attachment means 321.

Figure 8:
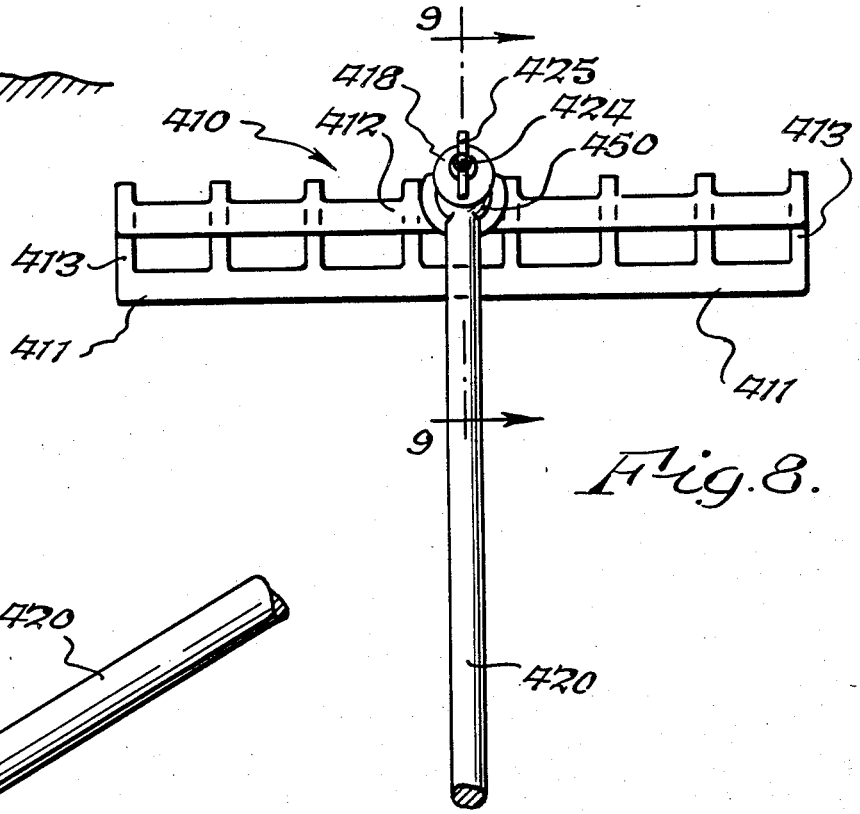
FIG. 8 is a plan view of the invention having a fixed connecting means with adjustable means for adjusting the lateral angle of the elongated retrieval head to the handle.
Figure 9:
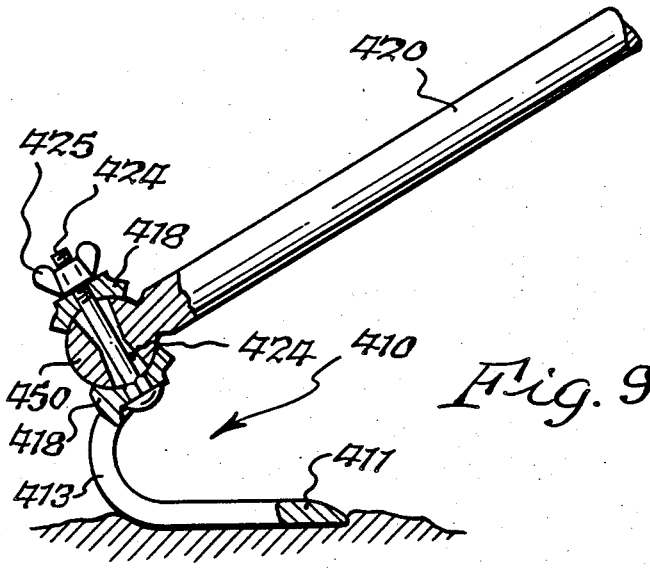
FIG. 9 is a vertical cross-sectional view of the invention depicted in FIG. 8.

FIGS. 8 and 9 illustrate an embodiment of the invention having elongated ball retrieval head 410, comprising lower stabilizing member 411, tines 413, upper stabilizing member 412 and adjustable means for adjusting the lateral angle of the elongated retrieval head to fixed handle 420. The adjustable means comprises support bodies 418, bolt pin 424, locking nut 425 coacting to lock ball shaped end 450 of the handle at adjustable lateral angles.

It can be seen that there has been disclosed a novel golf ball retriever having utility as a rake and sand leveling device which is compact, portable and effective in its retrieving action. Numerous modifications and variations of the ball retriever will be apparent to one skilled in the art and the invention is intended to encompass such.

What is claimed is:

1. A golf ball retrieving device comprising:

an elongated ball retrieval head containing fixed upper and lower stabilizing members, said lower fixed stabilizing member extending the elongated length of the elongated head and providing a generally straight edge for engaging a golf ball;

a plurality of curved tines, spaced apart a distance from about 30% to about 99% of the diameter of a golf ball, extending between said fixed upper and lower stabilizing members, each said tine including a bight portion having a radius of curvature from about 70% to about 150% of the radius of a golf ball, a guiding leg portion extending from the bight portion a distance of greater than about one-half the radius of curvature of the bight portion and fixedly connecting with and not extending beyond said lower stabilizing member, and means for fixedly connecting said upper stabilizing member to said bight portion;

means for connecting an elongated handle to said retrieval head so that the included angle of the guiding legs of said tines relative to the central axis of said handle is less than about 80°.

2. The device of claim 1 wherein said means for fixedly connecting said upper stabilizing member to said bight portion of said tines comprises a supporting leg extending from said bight portion of each said tine to said upper stabilizing member.

3. The device of claim 1 further including an elongated handle connected to said retrieval head.

4. The device of claim 3 including means for removably connecting said ball retrieval head to said elongated handle.

5. The device of claim 3 wherein said handle comprises an elongated telescoping handle.

6. The device of claim 1 wherein said means for connecting said handle to said head is an adjustable angle connecting means.

7. The device of claim 1 wherein said means for connecting said handle to said head is selected from fixed, spring clip, threaded socket and pin connecting means.

8. The device of claim 1 wherein each guiding leg of said tines extends a distance equal to about one-half to about four radii of the curvature of said bight portion.

9. The device of claim 8 wherein each guiding leg of said tines extends a distance equal to about one to about three radii of the curvature of said bight portion.

10. The device of claim 1 wherein at least one of said tines is rigid.

11. The device of claim 1 wherein at least one of said tines is semi-rigid.

12. The device of claim 1 wherein said means for connecting said handle to said head includes adjustable means for adjusting the included angle of the guiding legs of the tines of the elongated retrieval head to the handle.

13. The device of claim 1 wherein said means for connecting said handle to said head includes adjustable means for adjusting the lateral angle of the elongated retrieval head to the handle.

14. The device of claim 1 wherein said elongated retrieval head is telescopically compressible.

15. The device of claim 1 wherein said elongated head is made of plastic.

16. The device of claim 1 wherein said elongated head is made of metal.

17. The device of claim 1 wherein said elongated retrieval head includes ball retaining means.

* * * * *